US005293202A

United States Patent [19]

Adachi et al.

[11] Patent Number: 5,293,202

[45] Date of Patent: Mar. 8, 1994

[54] IMAGE FIXING APPARATUS

[75] Inventors: Nobukazu Adachi, Tokyo; Yuzo Isoda, Yokohama; Toshio Miyamoto, Tokyo; Yohji Tomoyuki, Yokohama, all of Japan

[73] Assignee: Canon Kabushiki Kaisha, Tokyo, Japan

[21] Appl. No.: 818,451

[22] Filed: Jan. 3, 1992

Related U.S. Application Data

[63] Continuation of Ser. No. 475,796, Feb. 6, 1990, abandoned.

[30] Foreign Application Priority Data

Feb. 8, 1989 [JP] Japan ..... 64-029422
Jul. 24, 1989 [JP] Japan ..... 64-191102

[51] Int. Cl.[5] ..... G03G 15/20
[52] U.S. Cl. ..... 355/282; 355/315
[58] Field of Search ..... 355/282, 285, 289, 290, 355/295, 315

[56] References Cited

U.S. PATENT DOCUMENTS

| | | | |
|---|---|---|---|
| 3,938,950 | 2/1976 | Weiler et al. | 432/59 |
| 3,955,889 | 5/1976 | Ishiguro et al. | 355/315 |
| 3,981,085 | 9/1976 | Franko | 355/315 |
| 4,065,120 | 12/1977 | Imaizumi et al. | 271/174 |
| 4,487,158 | 12/1984 | Kayson | 355/315 XR |
| 4,687,696 | 8/1987 | Satoji | 428/192 |
| 4,812,873 | 3/1989 | Inagaki et al. | 355/290 |
| 4,821,064 | 4/1989 | Mills et al. | 355/315 |
| 4,870,464 | 9/1989 | Haya et al. | 355/282 |
| 4,873,548 | 10/1989 | Kobayashi et al. | 355/200 |
| 4,905,049 | 2/1990 | Bickerstaff et al. | 355/284 |

FOREIGN PATENT DOCUMENTS

| | | | |
|---|---|---|---|
| 0081241 | 7/1978 | Japan | 355/315 |
| 57-116375 | 7/1982 | Japan . | |
| 0098474 | 6/1985 | Japan | 355/315 |
| 61-150369 | 7/1987 | Japan . | |

*Primary Examiner*—Lincoln Donovan
*Assistant Examiner*—Christopher Horgan
*Attorney, Agent, or Firm*—Fitzpatrick, Cella, Harper & Scinto

[57] ABSTRACT

An image fixing apparatus for fixing a toner image on an image supporting material. A guiding member for guiding the image supporting material is provided without contact to an image fixing rotatable member but with a predetermined small clearance. In order to maintain the predetermined clearance, spacers are provided at positions outside the maximum image forming region. The rotatable image fixing member is prevented from being damaged, and in addition, the image supporting material is prevented from being wrapped on the rotatable member.

26 Claims, 10 Drawing Sheets

IMAGE FIXING APPARATUS

This application is a continuation of application Ser. No. 07/475,796 filed Feb. 6, 1990, now abandoned.

FIELD OF THE INVENTION AND RELATED ART

The present invention relates to an image fixing apparatus for fixing a toner image, usable with a copying machine or electrophotographic printer.

A roller fixing apparatus for an image forming apparatus is known wherein rollers are press-contacted to each other to form a nip therebetween, through which an image supporting member for supporting an unfixed toner image is passed, by which the toner image is fixed.

FIG. 19 shows an example of such an image fixing apparatus. The apparatus comprises a fixing roller 10 containing a heater H therein and a pressing roller 11 press-contacted thereto.

The toner image supporting member is passed through the nip with its toner image supporting side contacted to the fixing roller, and the unfixed toner image is fixed by heat and pressure.

Separating pawl 12 functions to prevent the image supporting member from wrapping around the fixing roller 10, and they are rotatably supported on a rotational shaft 13, and are press-contacted to the fixing roller 10 by a spring 14.

Designated by reference numerals 15 and 16 are inlet guides, and 17 is an outlet guide.

However, such an apparatus involves the following problems. First, the roller is easily damaged because the edges of the separating pawls 12 are press-contacted to the fixing roller. In addition, the toner off-set to the fixing roller is scraped by the separating pawls 12, and the toner is gradually accumulated on the edges of the separating pawls 12. The accumulated toner is solidified thereon, and it contaminates the image supporting member, or the image supporting member is not properly separated from the roller. If the fixing roller is damaged, a stripe or stripes appear on the image, which is not preferable. Furthermore, since the edges of the separating pawls are contacted to the roller, a jam clearance operation is difficult with the possibility of damaging the separating pawls, if the image supporting member is jammed by wrapping on the roller or the like.

In view of the above, it is considered that the image supporting member is separated from the roller without use of the separating pawl by using a reduced outside diameter of the fixing roller, thus increasing the curvature of the roller surface in an attempt to increase the resilient repelling force of the supporting member beyond the adhering force of the toner. However, if only the resilient force of the supporting member is used to separate it from the roller, the separating force is small with the result that the image supporting member is sometimes wrapped on the roller, when the supporting member is a thin sheet having small resilient force as in the case of a sheet having basis weight of 60 g/m$^2$, when the toner adhering force is large as in the case of a large toner area on the sheet (solid black image, for example), or when the parting property of the fixing roller relative to the toner is deteriorated due to long term use.

The above described fixing apparatus is provided with an inlet guide and outlet guide to guide the image supporting member. The positional relation between these guides and the roller is very important from the standpoint of preventing occurrence of wrinkle and curl of the image supporting member, and therefore, the guide has to be positioned very accurately.

SUMMARY OF THE INVENTION

Accordingly, it is a principal object of the present invention to provide an image fixing apparatus in which the roller is prevented from being damaged, by which the fixed images are maintained in good order, and in addition, the image supporting member is prevented from being wrapped on the roller.

It is another object of the present invention to provide an image fixing apparatus comprising guiding means capable of assuredly guide the image supporting member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
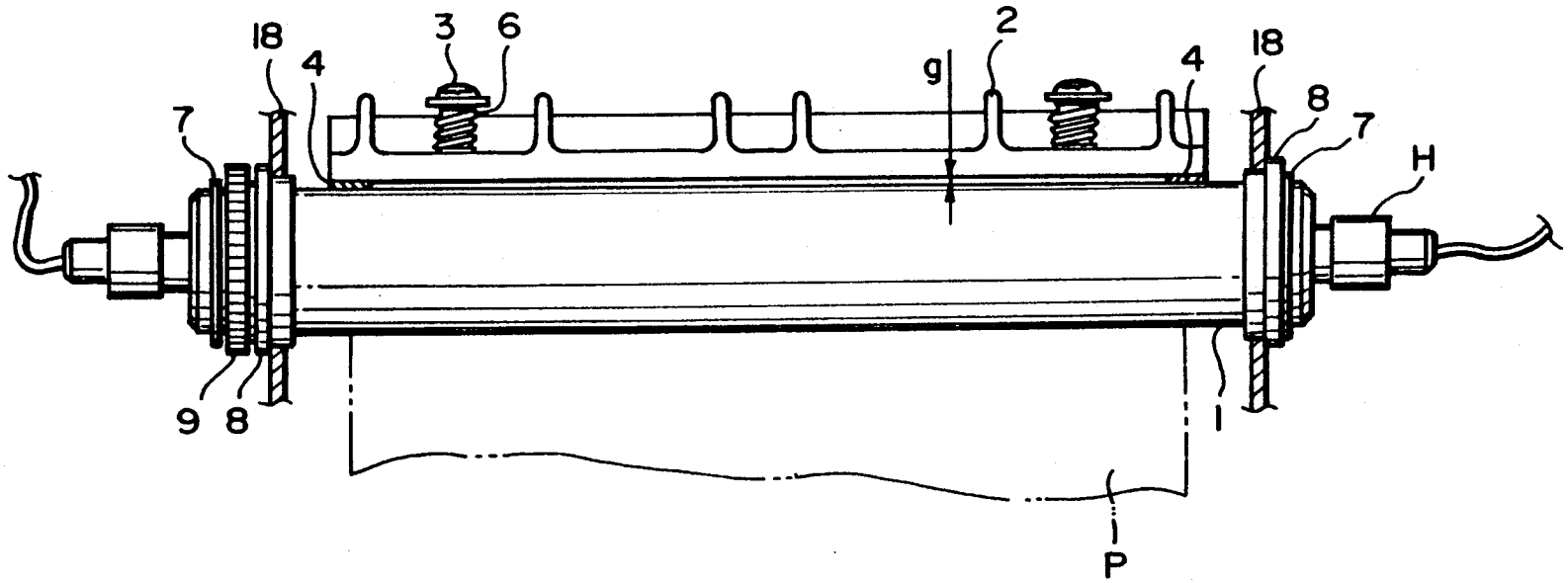
FIG. 1 is a top sectional view of an image fixing apparatus according to an embodiment of the present invention.

Preferred embodiments of the present invention will be described in conjunction with the accompanying drawings in which like reference numerals are assigned to the elements having the corresponding functions.

Figure 2:
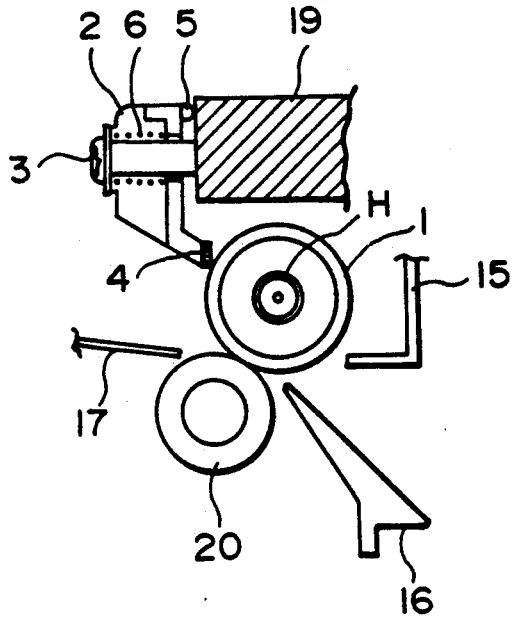
FIG. 2 is a side cross-section of the image fixing apparatus of FIG. 1.

FIG. 1 is a top sectional view of an image fixing apparatus according to an embodiment of the present invention, and FIG. 2 is a side cross-section thereof. The apparatus comprises a heating roller (fixing roller) 1 having a fluorinated resin surface layer with good parting properties, a separating guide (guiding means) for preventing an image supporting material P such as paper for supporting a toner image, screws 3 for resiliently supporting the separating guide 2, and spacers 4 for stably providing a small gap g disposed adjacent end portions of the heat roller 1 and the separating guide 2. In this embodiment, they are fixed on the separating guide 2 and are made of heat resistive material exhibiting good sliding properties. It further comprises a projection 5 for providing a pivot for pivotal movement of the separating guide 2, a spring 6 for resiliently supporting the separating guide 2, a halogen heater (heating means) H for supplying heat to the heat roller 1, bearings 8 for supporting the heat roller, and a gear 9 for driving the heating roller 1, which is driven by an unshown driving mechanism. A stopper 7 functions to limit movement of the heat roller 1 in its longitudinal direction. A pressing roller 20 is press-contacted to the heating roller 1 and is provided with an elastic layer made of silicone rubber. The pressing roller 20 rotates together with the heating roller 1.

The heating roller 1 and the pressing roller 20 function as fixing rotatable members for fixing the toner image on the image supporting material. Of these rollers, the heating roller 1 is contactable to the toner image supporting side of the image supporting material.

The apparatus further comprises inlet guides 15, 16 for guiding reception of the toner image supporting member by the rollers, an outlet guide 17 for guiding discharge of the supporting material therefrom, and frames 18 and 19 of the fixing apparatus.

Figure 3:
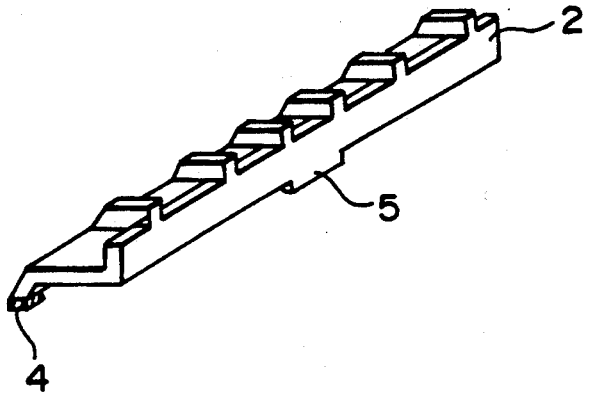
FIG. 3 is a perspective view of a separating guide.

FIG. 3 is a perspective view of the separating guide 2. As will be understood, the projection 5 of the separating guide 2 is abutted to the frame 19 of the fixing apparatus, and is also supported by abutting spacers 4 at the longitudinal ends of the heat roller 1, thus supported at three points, by the screws through a spring 6.

The abutting spacers 4 are disposed adjacent the longitudinal ends of the heating roller 1 and outside the maximum image formation area in which an unfixed toner image is formed on the supporting material, and at the positions corresponding to the neighborhood of the lateral edges of a maximum size image supporting material usable with the apparatus.

In this embodiment, the spacers 4 are at the lateral edges of the maximum size supporting material, by which the separating function at the spacers 4 are improved.

When the fine gap g provided by the spacer 4 is small, there is a liability that the off-set toner is accumulated, and if, on the contrary, it is large, the separating power decreases.

Therefore, the fine gap G is preferably 0.1–0.6 mm. The separating guide is preferably formed such that the fine gap g extends in parallel with the longitudinal direction of the heating roller 1, that is, the direction of the generating line of the roller 1.

Figure 4:
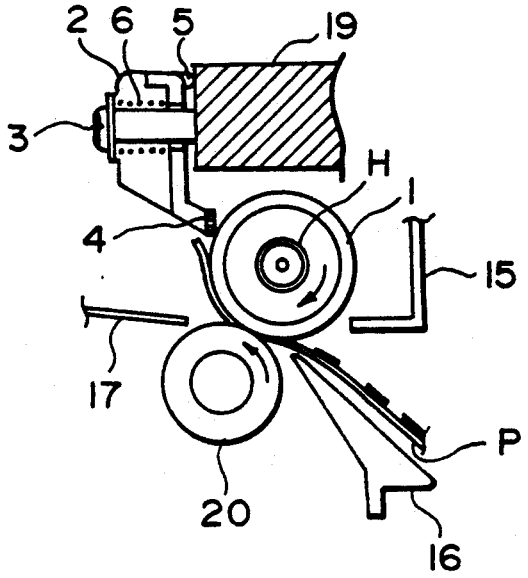
FIGS. 4 and 5 are sectional views illustrating movement of the image supporting member in the image fixing apparatus of FIG. 1.
Figure 5:
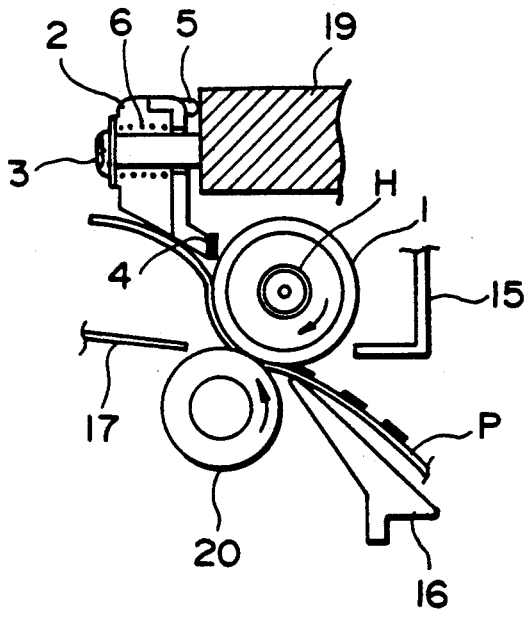

Referring to FIGS. 4 and 5, the movement of the image supporting member will be described in the image fixing apparatus of this embodiment. As shown in FIG. 4, the unfixed toner image on the supporting material P is passed through the nip formed between the rollers, by which it is heated and pressed, so that the toner image is fixed. During this process, the supporting material P is closely contacted to the heating roller 1, but its leading edge is slightly apart from the heating roller 1, and is separated from the heating roller 1 by the edge of the separating guide 2, and then, is discharged to a discharging portion not shown (FIG. 5).

Thus, the present embodiment is particularly effective in the case of a small diameter heating roller such as the roller having a diameter not more than 30 mm.

In this embodiment, the abutting spacers 4 are in sliding contact to the heating roller. It is possible for the heating roller to be damaged by the contacts occurring during long term use. However, since they are disposed outside the maximum image area, the fixed image is not adversely influenced, even if the damage occurs.

When, however, the roller is worn to a certain great extent, the small gap g changes.

To avoid this, it is preferable that the surface layer having the good parting properties, particularly, fluorinated resin layer is formed at the portion of the heating roller 1 where the spacers 4 are contacted.

Furthermore, it is preferable that the surfaces of the spacers 4 which are in contact with the heating roller 1 are coated with the fluorinated resin.

Figure 6:
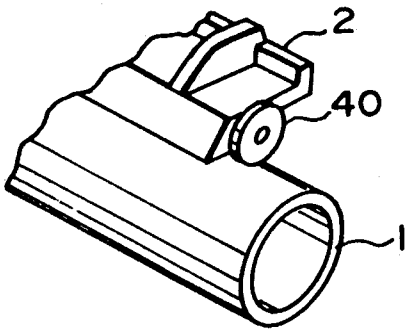
FIG. 6 is a partial perspective view of an image fixing apparatus according to another embodiment of the present invention.

FIG. 6 shows another embodiment of the present invention. In this embodiment, the spacers at the end portions of the separating guide are in the form of rollers 40 which are rotatable following the heating roller 1. This embodiment is free from the problem of wear.

Where the separating guide is made of resin which is generally easily deformed due to heat, it is particularly preferable to assure the maintenance of the fine gap by the spacer. It is also preferable that the structure is incorporated in a guiding member such as inlet guide.

Figure 7:
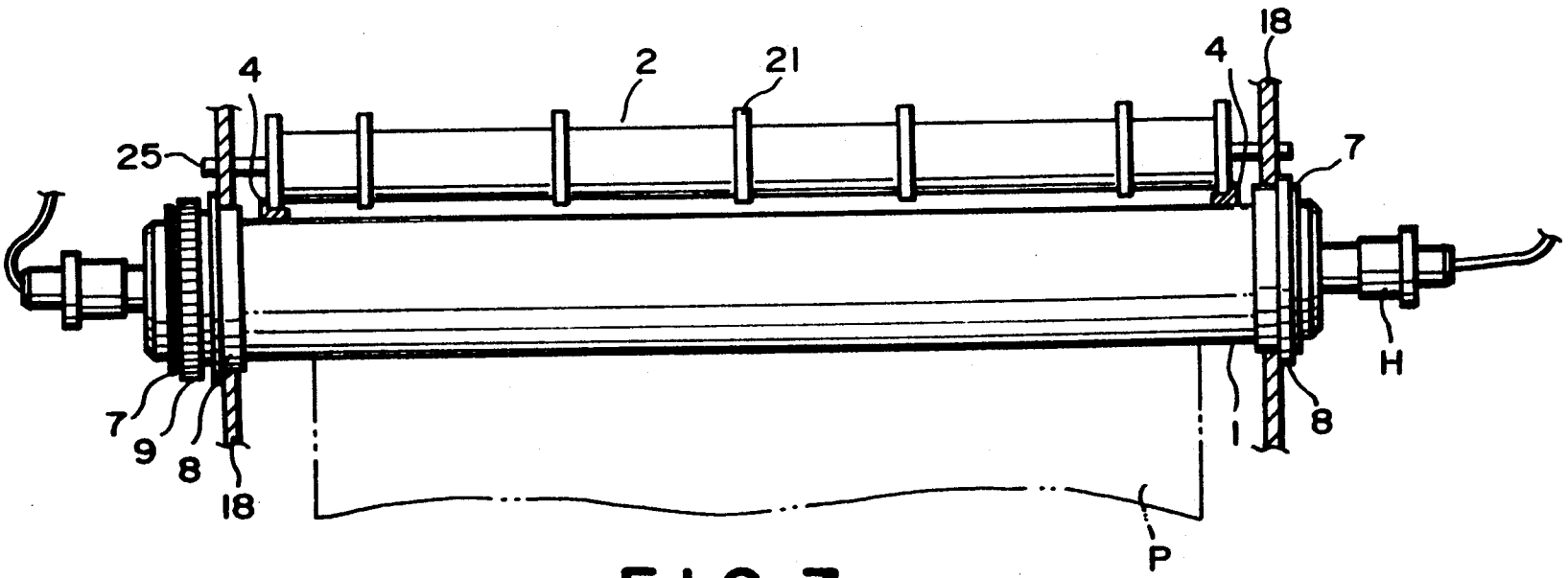
FIG. 7 is a top sectional view of an image fixing apparatus according to a further embodiment of the present invention.
Figure 8:
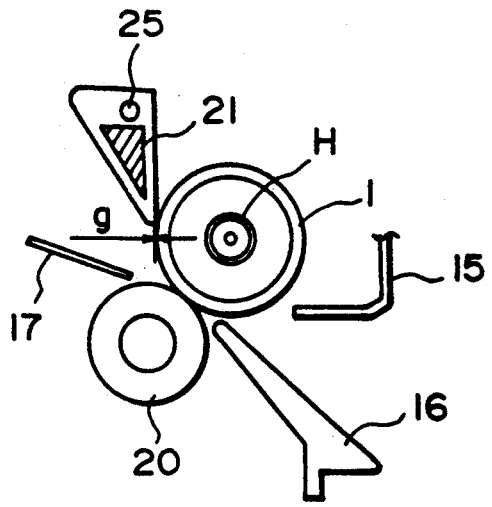
FIG. 8 is a central cross-section of the apparatus of FIG. 7 embodiment.
Figure 9:
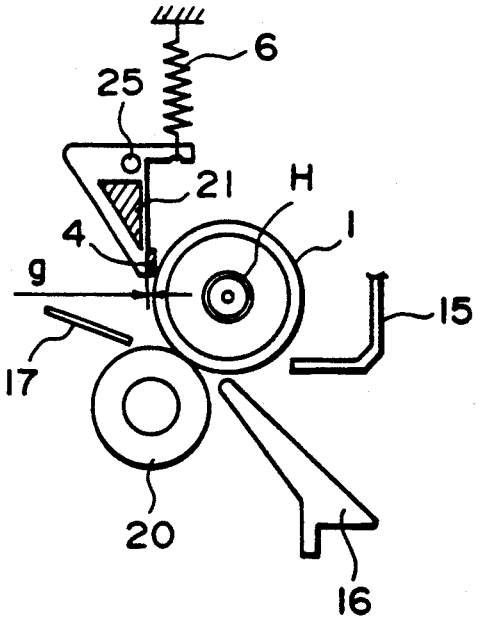
FIG. 9 is a side cross-section of the apparatus of FIG. 7 embodiment.

FIGS. 7–9 show a further embodiment, wherein the separating guide 2 is urged toward the heating roller 1 by a tension spring 6, the separating guide 2 being pivotable about a pivot 25. A plurality of ribs 21 are provided at least at such a portion as is close to the heating roller 1, and the image supporting member is separated by the ribs 21. By using such ribs, the portion where the separating guide and the toner image are contacted can be reduced.

Figure 10:
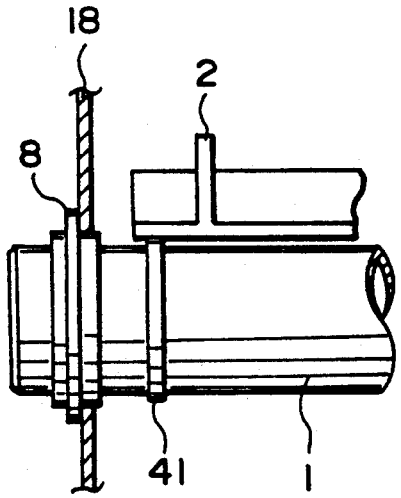
FIGS. 10–14 illustrate image fixing apparatuses according to further embodiments.

FIG. 10 shows an apparatus according to a yet further embodiment, wherein the spacer 41 is provided at the heating roller side.

Figure 11:
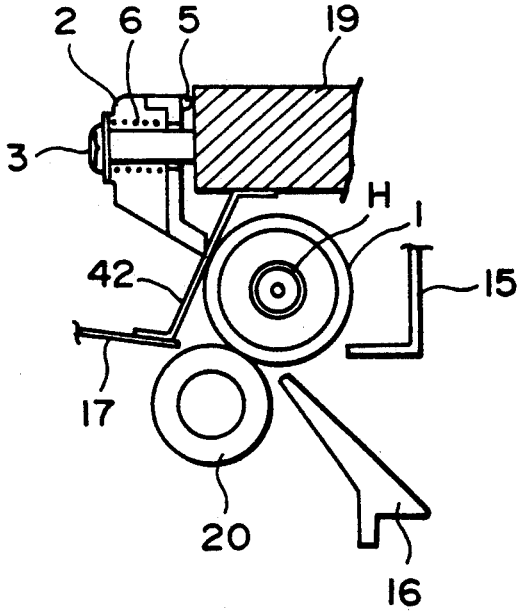

FIG. 11 shows an apparatus according to a further embodiment, wherein spacers 42 are independent from the separating guide 2 and from the heating roller 1.

Figure 12:
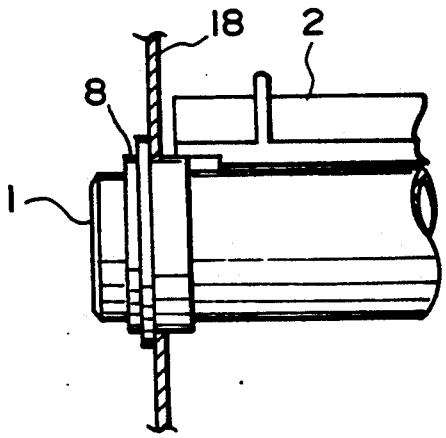

FIG. 12 shows an apparatus according to a further embodiment, wherein the small gap is assured by abutment of the separating guide 2 to the bearing 8.

Figure 13:
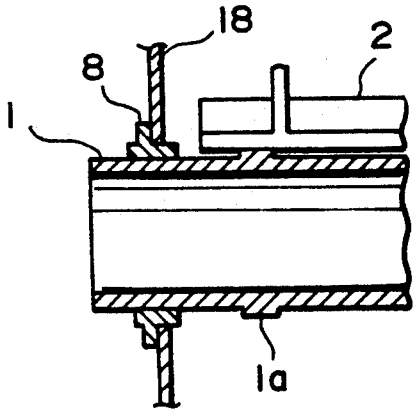

FIG. 13 shows an apparatus according to a further embodiment, wherein a part of the surface layer of the heating roller 1 is made thicker (1*a*), and the thick portion 1*a* is in contact with the separating guide 2 to assure the small gap.

Figure 14:
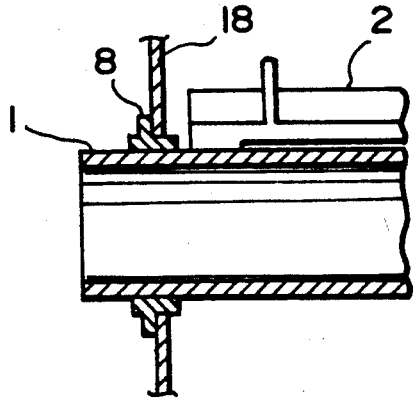

FIG. 14 shows an apparatus according to a further embodiment, wherein the separating guide is made through an injection process of resin material, and the spacer portions are formed at the time of the injection process. The spacers in the embodiments of FIGS. 7–14, are disposed outside the maximum image formation area on the image supporting material, similarly to the spacers as in FIG. 1 embodiment. The spacers in the embodiments of FIGS. 7–14, may be provided with surface parting layer, similarly to FIG. 1 embodiment. The spacers used in the embodiments of the present invention may be used for another guiding member for guiding the image supporting material, as well as the separation guide.

Figure 15A:
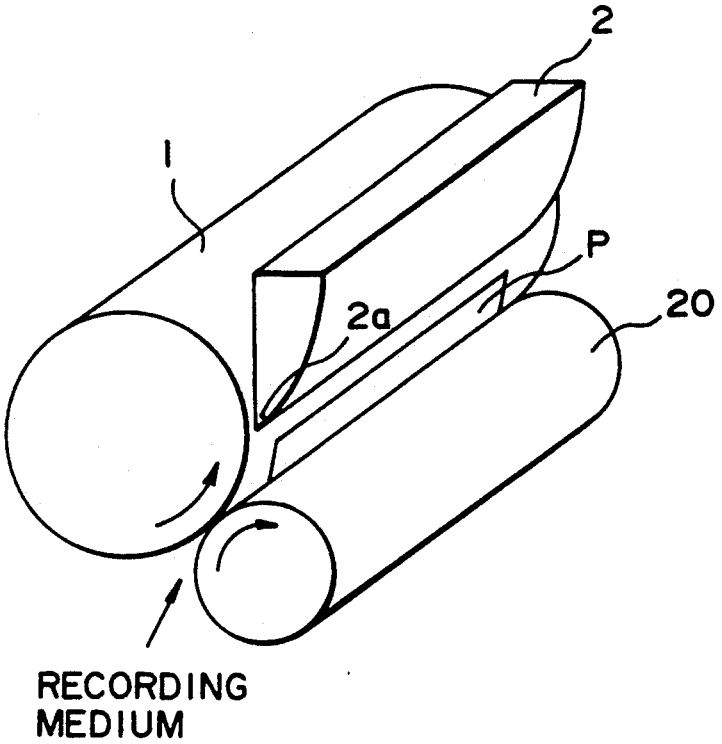
FIGS. 15A and 15B are perspective and sectional views of an image fixing apparatus according to a further embodiment.
Figure 15B:
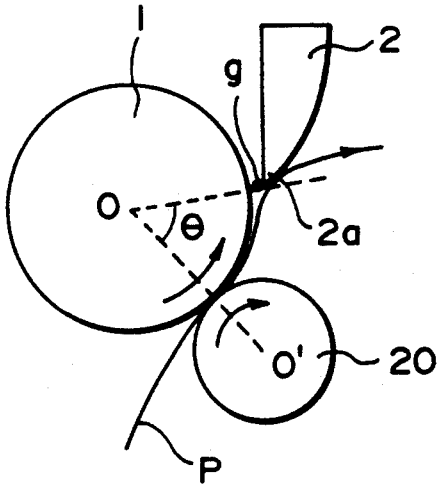

FIGS. 15A and 15B show an image fixing apparatus according to a yet further embodiment. A heat fixing roller comprises an aluminum hollow core metal having a thickness of 2 mm and an outer diameter of 18 mm, and a resin layer made of PFA or the like coated on the core metal in a thickness of several tens microns. Within the fixing roller 1, there is a halogen heater to heat the fixing roller and to maintain the constant temperature thereof using an unshown temperature detecting element such as a thermister.

A pressing roller 20 comprises a stainless steel core metal having a diameter of 9 mm, and a silicone rubber layer having a thickness of 3.5 mm, the silicone rubber layer having good heat-resistive and parting property.

A separating guide 2 functions to guide the recording material P (image supporting material). The separating guide 2 is out of contact with the fixing roller 1. The separating guide 2 prevents the recording material from wrapping on the fixing roller. Between an edge 2*a* and the fixing roller 1, there is formed a small gap g. The small gap g extends along the length of the fixing roller 1.

The edge 2*a* of the guiding member is positioned 55 degrees ($\theta$) away from a line connecting the center O of the fixing roller and the center O' of the pressing roller about the center O of the fixing roller toward downstream with respect to the rotational direction of the fixing roller.

Table 1 shows the difference in the separating effect due to the difference of the small gap g. The relation among the gap g, the leading margin and the number of jam occurrences is shown when 100 sheets having the solid black image shown in FIG. 16 were processed. The angle $\theta$ was fixedly 55 degrees.

TABLE 1

| | | Small Gap g (mm) | | | | | | | |
|---|---|---|---|---|---|---|---|---|---|
| | | 1.0 | 0.8 | 0.7 | 0.6 | 0.5 | 0.4 | 0.2 | 0.1 |
| Leading Margin (mm) | 0 | 100 | 60 | 30 | 15 | 8 | 4 | 0 | 0 |
| | 1 | 95 | 50 | 20 | 2 | 1 | 1 | 0 | 0 |
| | 2 | 90 | 40 | 15 | 0 | 0 | 0 | 0 | 0 |
| | 3 | 90 | 40 | 10 | 0 | 0 | 0 | 0 | 0 |
| | 4 | 85 | 35 | 4 | 0 | 0 | 0 | 0 | 0 |
| | 5 | 85 | 30 | 2 | 0 | 0 | 0 | 0 | 0 |
| | 6 | 80 | 30 | 2 | 0 | 0 | 0 | 0 | 0 |
| | 7 | 80 | 30 | 1 | 0 | 0 | 0 | 0 | 0 |

Generally, the leading margin is not less than 2 mm, and therefore, it is understood that the jam (wrapping of the recording material)hardly occurs if the gap g is larger than zero and not more than 0.6 mm.

Figure 16:
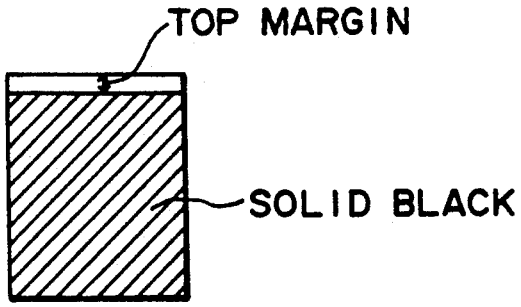
FIG. 16 is a top plan view of an image on a recording material in the embodiment.

Table 2 shows the difference in the separating effect due to the difference in the angle $\theta$. The relation among the angle $\theta$, the leading margin and the number of jam occurrences is shown when 100 sheets having the solid black image as shown in FIG. 16 were processed for the image fixing. Here, the gap g was fixedly 0.6 mm.

TABLE 2

| | | Angle $\theta$ | | | | | | | | | | |
|---|---|---|---|---|---|---|---|---|---|---|---|---|
| | | 10° | 20° | 30° | 40° | 50° | 60° | 70° | 80° | 90° | 100° | 110° |
| Leading Margin (mm) | 0 | 100 | 60 | 30 | 15 | 8 | 4 | 0 | 0 | 0 | 4 | 8 |
| | 1 | 95 | 50 | 20 | 2 | 1 | 1 | 0 | 0 | 0 | 1 | 2 |
| | 2 | 90 | 40 | 15 | 0 | 0 | 0 | 0 | 0 | 0 | 1 | 1 |
| | 3 | 90 | 40 | 10 | 0 | 0 | 0 | 0 | 0 | 0 | 0 | 0 |
| | 4 | 85 | 35 | 4 | 0 | 0 | 0 | 0 | 0 | 0 | 0 | 0 |
| | 5 | 85 | 30 | 2 | 0 | 0 | 0 | 0 | 0 | 0 | 0 | 0 |
| | 6 | 80 | 30 | 2 | 0 | 0 | 0 | 0 | 0 | 0 | 0 | 0 |
| | 7 | 80 | 30 | 1 | 0 | 0 | 0 | 0 | 0 | 0 | 0 | 0 |

Generally, the leading margin is not less than 2 mm, and therefore, the angle $\theta$ is preferably not less than 40 degrees. If the angle $\theta$ is larger than 90 degrees, the separating point between the recording material and the fixing roller is shifted upstream beyond the guiding member with respect to the rotational direction of the roller with the result that the sheets are not smoothly discharged, so that some sheets were jammed. Therefore, the angle $\theta$ is preferably not less than 40 degrees and to more than 90 degrees.

The stickiness of the toner on the recording material tends to wrap the recording material on the fixing roller. The present invention utilizes the tendency of the repelling force of the recording material against the stickiness of the toner, and the instance when the leading edge of the recording material is slightly separated from the fixing roller is utilized to separate the recording material from the fixing roller with the aid of the separating guide 2. Therefore, when the separating guide is disposed at the portion where the repelling force of the recording material is produced, the separating operation will be stabilized.

Figure 17:
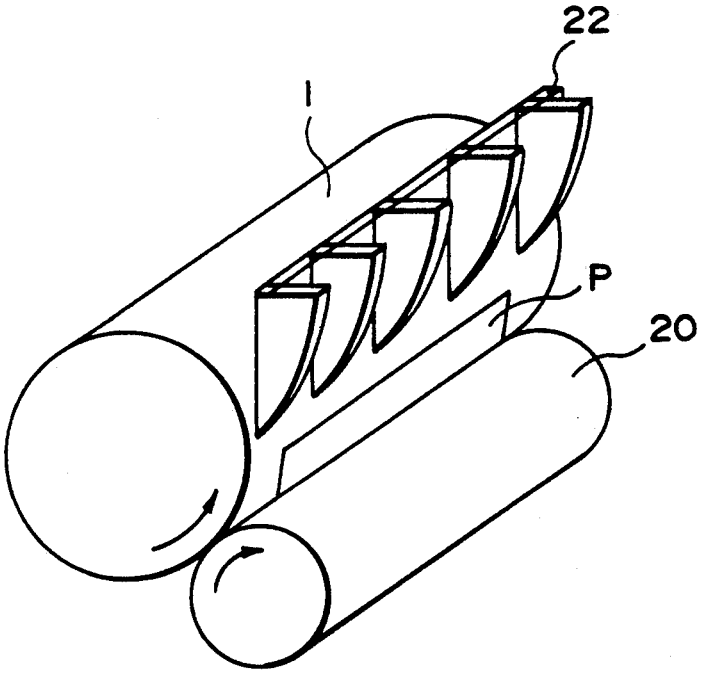
FIGS. 17 and 18 are perspective views of an image fixing apparatus according to a yet further embodiment.

FIG. 17 shows an example of a guiding member which is in the form of separating pawls 22 not contacted to the fixing roller. In this embodiment, the gap between the free end of the separating pawl 22 and the fixing roller 1 is 0.6 mm and the angle $\theta$ is 55 degrees. Using the non-contact separating pawl, the recording material can be separated from the fixing roller as in the foregoing embodiments, that is, the separating pawls 22 wedges between the recording material and the fixing roller when the leading edge of the recording material is slightly separated from the fixing roller by its repelling force.

The effects of this example were the same as in the foregoing embodiment described referring to Tables 1 and 2.

Figure 18:
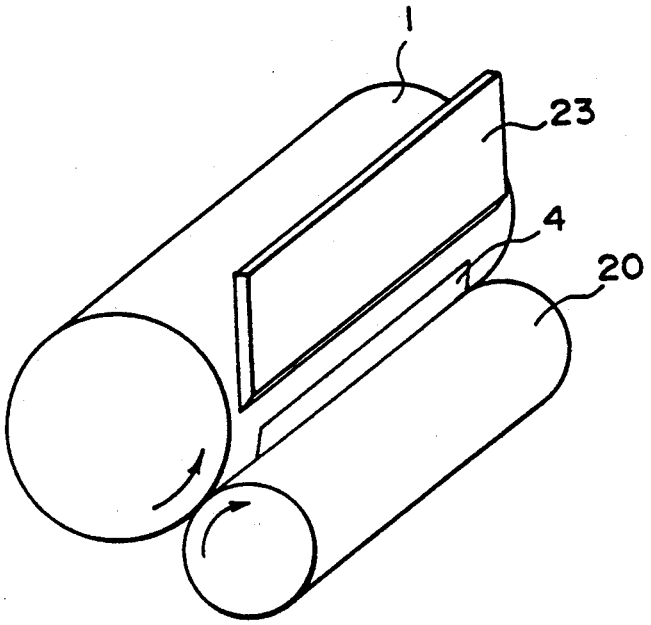
Figure 19:
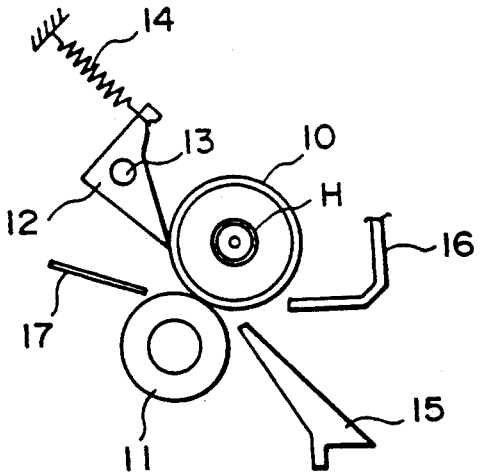
FIG. 19 PRIOR ART
FIG. 19 is a sectional view of a conventional image fixing apparatus.

FIG. 18 shows an embodiment wherein the guiding member is in the form of a blade 23 not contacted to the fixing roller. The gap g between the free end of the blade 23 and the fixing roller was fixedly 0.6 mm, and the angle $\theta$ was 55 degrees. The free end of the blade is cut into an acute angle in order to enhance the separating effect. In this embodiment, the same separating effects as stated with Tables 1 and 2 were confirmed.

As described in the foregoing, the stabilized separating function can be accomplished by maintaining the small gap g between the guiding member and the fixing roller and the angle $\theta$, independently from the configuration and material of the guiding member.

As described in the foregoing, the gap g should be adjusted accurately, and in order to meet this, it is preferable that the spacing means contacted to the guiding member and the fixing roller is used to assure the clearance.

As described in the foregoing, according to the present invention, the toner image supporting material is separated from the fixing roller by the guiding means such as a separating guide closely disposed with the small gap relative to the fixing rotatable member such as a fixing roller or belt. Therefore, the necessity for a separating pawl or pawls press-contacted to the rotatable member is eliminated, thus avoiding the problems with the conventional apparatus such as mechanical damage of the fixing roller due to the provision of the separating pawl and the resultant deterioration of the image.

In addition, the spacer is abutted to the rotatable member outside the maximum image area to assure the small clearance. Therefore, the accurate gap can be provided in high precision, and in addition, even if the rotatable member is damaged by the contact with the spacer, the toner image is not adversely affected.

The non-contact guiding member is particularly effective for the separation of the toner image supporting member from the rotatable member when it is used with a small diameter fixing rotatable member.

The present invention is applicable to the case where one or both of the rollers are crowned or reversely crowned, and in these cases the minimum and maximum gaps are maintained not less than 0.1 micron and not more than 0.6 micron.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a fixing rotatable member for fixing a toner image on an image supporting material; and a separating guide for separating the image supporting material from said fixing rotatable member, said separating guide being disposed along a direction of a generating line of said fixing rotatable member with a predetermined gap from a surface of said fixing rotatable member, a contact portion contacting a surface of said fixing rotatable member to form the gap;

wherein said contact portion partly overlaps with both a maximum sheet passage region and a non-sheet passage region.

2. An apparatus according to claim 1, wherein said contact portion is provided at each of the longitudinal end portions of said separating means.

3. An apparatus according to claim 1, wherein said contact portion has a surface layer possessing good parting properties.

4. An apparatus according to claim 3, wherein said surface layer is of fluorinated resin.

5. An apparatus according to claim 1, wherein said contact portion is outside a maximum image area.

6. An apparatus according to claim 1, wherein said fixing rotatable member is contactable to an unfixed toner image.

7. An apparatus according to claim 6, wherein said fixing rotatable member is heated by heating means.

8. An apparatus according to claim 1, wherein said predetermined gap is 0.1–0.6 mm.

9. An apparatus according to claim 1, wherein said separating guide has an end portion which is parallel with the generating line of said fixing rotatable member.

10. An apparatus according to claim 1, further comprising a pressing member for pressing against the fixing rotatable member, wherein the end portion of said separating guide is disposed within a range between 40 and 90 degrees from a line connecting a center of said fixing rotatable member and a center of said pressing member in a direction downstream with respect to rotational direction of said rotatable member.

11. An apparatus according to claim 1, wherein said fixing rotatable member has a diameter not more than 30 mm.

12. An apparatus according to claim 1, wherein said separating guide is a resin injection-molded.

13. An image fixing apparatus, comprising:

a fixing rotatable member for fixing a toner image n an image supporting material;

separating member for separating the image supporting material from said fixing rotatable member, said separating member being disposed along a direction of a generating line of said fixing rotatable member with a predetermined gap from a surface of said fixing rotatable member;

wherein separating member has plural ribs for separating a leading end of said image supporting material and for guiding the thus separated image supporting material.

14. An apparatus according to claim 13, wherein said fixing rotatable member is contactable to an unfixed toner image.

15. An apparatus according to claim 14, wherein said fixing rotatable member is heated by heating means.

16. An apparatus according to claim 13, wherein the predetermined gap is 0.1–0.6 mm.

17. An apparatus according to claim 13, wherein said separating member has an end portion which is parallel with the generating line of said fixing rotatable member.

18. An apparatus according to any one claim 13, further comprising a pressing member for pressing against the fixing rotatable member, wherein the end portion of said separating member is disposed within a range between 40 and 90 degrees from a line connecting a center of said fixing rotatable member and a center of said pressing member in a direction downstream with respect to rotational direction of said rotatable members.

19. An apparatus according to claim 13, wherein said fixing rotatable member has a diameter not more than 30 mm.

20. An apparatus according to claim 13, wherein said separating member is a resin injection-molded material.

21. An image fixing apparatus, comprising:

a fixing rotatable member for fixing a toner image on an image supporting material;

bearing means for rotatably supporting said fixing rotatable member; and separating means for separating the image supporting material from said fixing rotatable member, said separating means being disposed along a direction of a generating line of said fixing rotatable member with a predetermined gap form a surface of said fixing rotatable member, wherein said separating means has a contact portion for contact with said bearing means to maintain the gap.

22. An apparatus according to claim 21, wherein said separating means is supported on said bearing member adjacent opposite longitudinal ends.

23. An image fixing apparatus, comprising:

a fixing rotatable member for fixing a toner image on an image supporting material;

separating guide for separating the image supporting material from said fixing rotatable member, said separating guide being disposed along a direction of a generating line of said fixing rotatable member with a predetermined gap form a surface of said fixing rotatable member, an urging member for urging said separating guide toward said fixing rotatable member; and a positioning portion for receiving an urging force from said urging member to position said separating guide;

wherein three of such positioning portions are provided at a central position and end portions of said separating guide.

24. An apparatus according to claim 23, wherein said separating means has three projections in total for the positioning with the three points.

25. An apparatus according to claim 24, wherein said projections adjacent the end portions are contacted to a surface of said fixing rotatable member.

26. An apparatus according to claim 24, further comprising bearing means for rotatably supporting said fixing rotatable member, wherein the projections at the end portions are contacted to said bearing means.

* * * * *

UNITED STATES PATENT AND TRADEMARK OFFICE

CERTIFICATE OF CORRECTION

PATENT NO. : 5,293,202

DATED : March 8, 1994

INVENTOR(S) : NOBUKAZU ADACHI, ET AL.

It is certified that error appears in the above-indentified patent and that said Letters Patent is hereby corrected as shown below:

On the Title Page:
Line FAPD, "64-029422" should read --1-029422--, and
"64-191102" should read --1-191102--.

Column 2,
Line 14, "guide" should read --guiding--.

Column 3,
Line 45, "spacer 4" should read --spacers 4--; and
Line 49, "gap G" should read --gap g--.

Column 5,
Line 42, "material)hardly" should read --material) hardly--.

Column 6,
Line 3, "to" should read --not--.

UNITED STATES PATENT AND TRADEMARK OFFICE

CERTIFICATE OF CORRECTION

PATENT NO. : 5,293,202

DATED : March 8, 1994

INVENTOR(S) : NOBUKAZU ADACHI, ET AL.

It is certified that error appears in the above-indentified patent and that said Letters Patent is hereby corrected as shown below:

Column 8,

Line 7, "a," should be deleted;
Line 9, "n" should read --on--;
Line 17, "separating" should read --said separating--;
Line 31, "any one" should be deleted;
Line 39, "bers." should read --ber.--; and
Line 60, "member" should read --means--.

Column 9,

Line 1, "form" should read --from--.

Signed and Sealed this

Thirteenth Day of September, 1994

*Attest:*

*Attesting Officer*

Bruce Lehman

BRUCE LEHMAN

*Commissioner of Patents and Trademarks*